US006347703B1

(12) United States Patent
Betts

(10) Patent No.: US 6,347,703 B1
(45) Date of Patent: Feb. 19, 2002

(54) SELF ADHERING WRAPPER

(76) Inventor: Suzanne Betts, 1376 Anchor Ct., Wantagh, NY (US) 11793-2322

( * ) Notice: Subject to any disclaimer, the term of this patent is extended or adjusted under 35 U.S.C. 154(b) by 332 days.

(21) Appl. No.: 09/401,056

(22) Filed: Sep. 22, 1999

Related U.S. Application Data

(63) Continuation-in-part of application No. 08/549,869, filed on Oct. 30, 1995, now Pat. No. 5,979,651.

(51) Int. Cl.[7] ..... B65D 73/00

(52) U.S. Cl. ..... 206/457; 206/813; 229/87.18; 229/87.19; 229/922; 229/923

(58) Field of Search ..... 206/457, 813, 206/820, 390; 428/40.1, 41.8, 41.7, 42.1; 229/116.5, 87.18, 87.19, 922, 923

(56) References Cited

U.S. PATENT DOCUMENTS 3,064,876 A * 11/1962 Warner ..... 229/87.19
5,004,144 A * 4/1991 Selga ..... 229/87.19
5,007,229 A * 4/1991 Weder et al. ..... 229/87.19
5,186,988 A * 2/1993 Dixon ..... 229/87.19
5,381,642 A * 1/1995 Weder et al. ..... 229/87.01
5,526,933 A * 6/1996 Weder ..... 206/423
5,542,597 A * 8/1996 Richards ..... 229/116.5
5,666,784 A * 9/1997 Weder ..... 206/423
5,738,215 A * 4/1998 Weder et al. ..... 206/423
5,743,398 A * 4/1998 Weder ..... 206/423

* cited by examiner

*Primary Examiner*—Shian Luong

(57) ABSTRACT

A sheet of flexible material. The sheet has a periphery in a rectangular configuration with four edges and four corners sized to conform to any of a plurality of boxes having a variety of shapes and sizes. Each sheet also has a back surface without any printing thereon and a front surface with or without decorative printing thereon. A pressure sensitive adhesive providing for removal and repositioning of the sheet is located on the back surface along the four side edges but terminates in proximity to the four corners. The adhesive forms an essentially rectangular adhesive frame having a periphery essentially co-extensive with the periphery of the sheet and a hollow interior and corners to facilitate handling. The adhesive may adhere to the front surface when wrapping a box or other item. The frame extends from the periphery toward the hollow interior whereby each sheet may be wrapped about a box so that portions of the adhesive contact, engage and attach to portions of the front surface for securing the sheet wrapped about at least a portion of the box or other item.

2 Claims, 7 Drawing Sheets

FIG 3
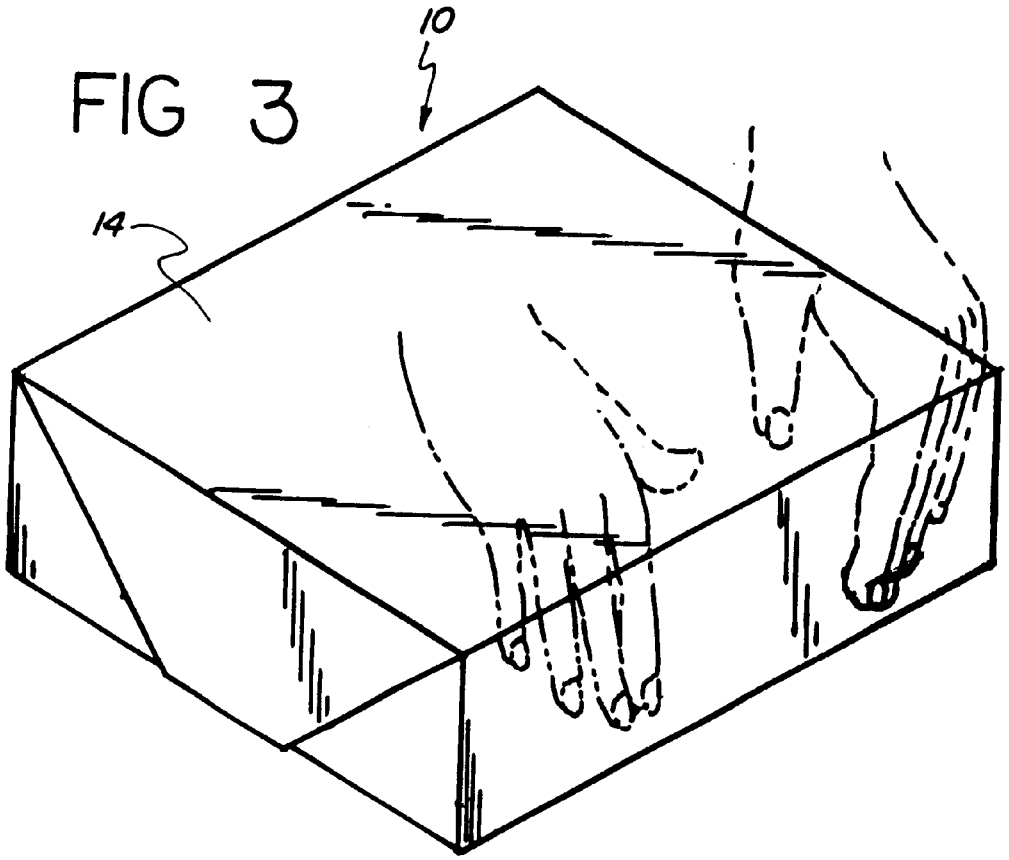
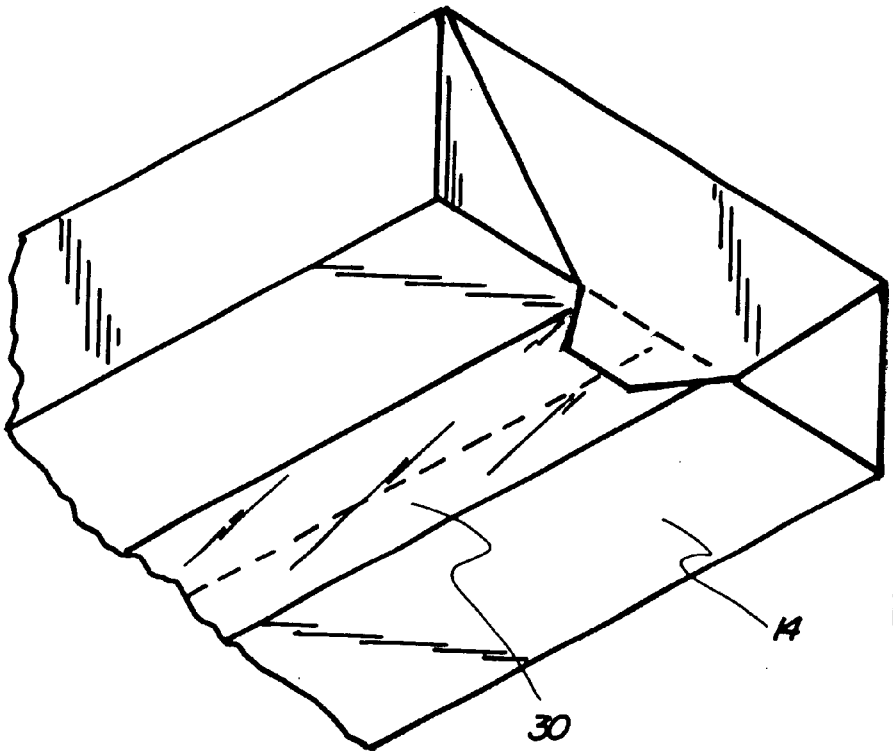
FIG 4

FIG 5
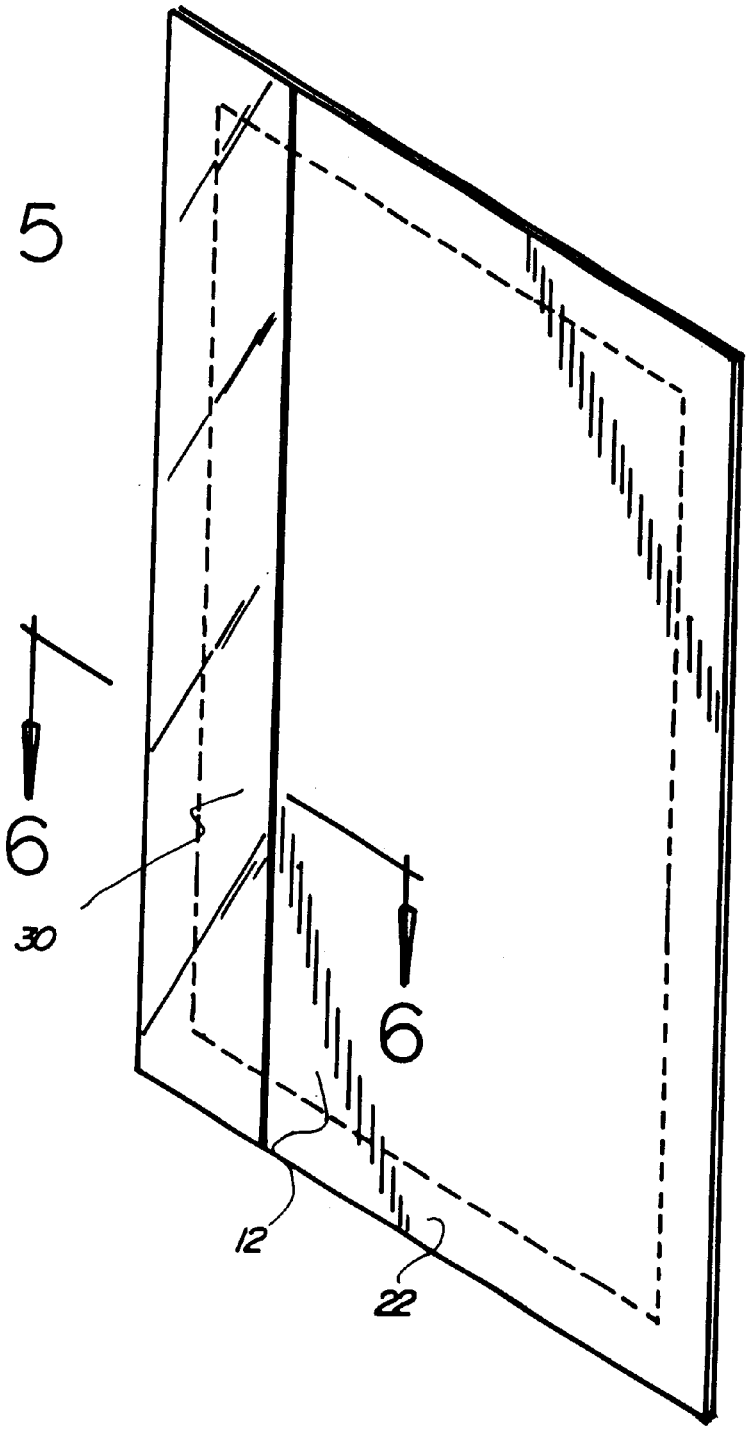
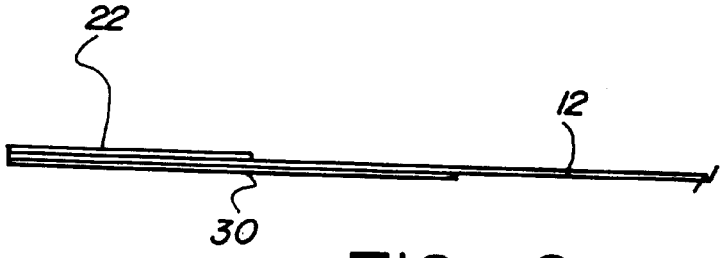
FIG 6

FIG. 9
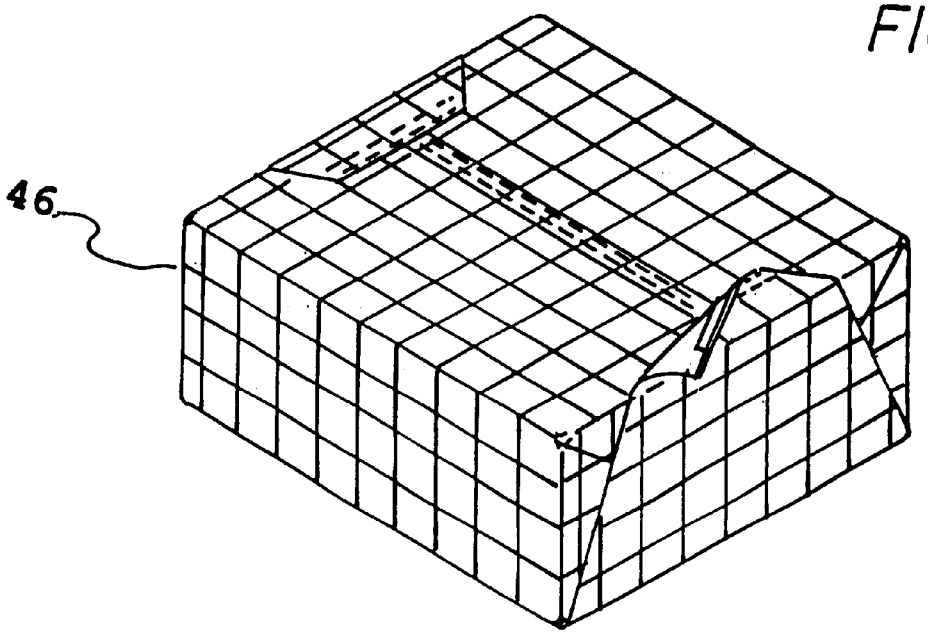
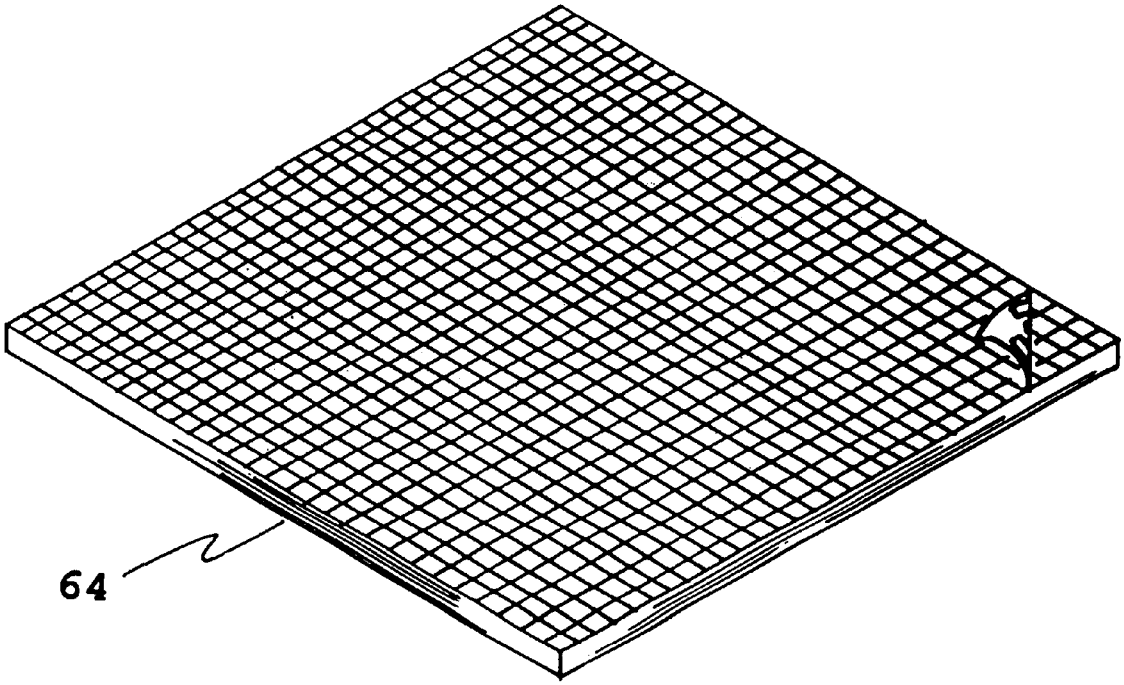
FIG. 10

SELF ADHERING WRAPPER

RELATED APPLICATION

This application is a Continuation-in-Part of application Ser. No. 08/549,869 filed Oct. 30, 1995 issued as U.S. Pat. No. 5,979,651, which is incorporated herein by reference.

BACKGROUND OF THE INVENTION

1. Field of the Invention

The present invention relates to a self adhering wrapper and more particularly pertains to allowing an item to be placed therein and concealed when the self adhering wrapper is placed in an operable configuration and further allowing reuse of the self adhering wrapping with adhesive material.

2. Description of the Prior Art

The use of wrapping material is known in the prior art. More specifically, wrapping material heretofore devised and utilized for the purpose of wrapping a variety of items are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 5,194,299 to Fry discloses a repositionable pressure-sensitive adhesive sheet material. U.S. Pat. No. 5,111,638 to Weder discloses a method for wrapping an object with a material having pressure sensitive adhesive thereon. U.S. Pat. No. 5,007,229 to Weder discloses a cling material connected to a portion of the sheet of material so that at least a portion of the cling material extends beyond the outer peripheral surface of the sheet of material. U.S. Pat. No. 4,726,509 discloses a gift wrapping assembly that comprises a box, bow, and ribbon. U.S. Pat. No. 4,508,223 discloses a preformed-pot cover package, for slidably receiving a plurality of columns of nested preformed pot covers in slots formed therein. Lastly, U.S. Pat. Design No. 272,103 discloses a sheet of gift wrapping paper showing a specific print design.

While these devices fulfill their respective, particular objectives and requirements, the aforementioned patents do not describe self adhering wrapper that is a pre-sized sheet of material with an adhesive strip for wrapping a variety of items. In this respect, the self adhering wrapper according to the present invention substantially departs from the conventional concepts and designs of the prior art, and in doing so provides an apparatus primarily developed for the purpose of allowing an item to be placed therein and concealed when the self adhering wrapper is placed in an operable configuration and further allowing reuse of the self adhering wrapper.

Therefore, it can be appreciated that there exists a continuing need for a new and improved self adhering wrapper which can be used for allowing an item to be placed therein and concealed when the self adhering wrapper is placed in an operable configuration and further allowing reuse of the self adhering wrapper with the adhesive material. In this regard, the present invention substantially fulfills this need.

SUMMARY OF THE INVENTION

In view of the foregoing disadvantages inherent in the known types of wrapping material now present in the prior art, the present invention provides an improved self adhering wrapper. As such, the general purpose of the present invention, which will be described subsequently in greater detail, is to provide a new and improved roll of flexible material. The roll is formed of a plurality of individual sheets coupled end to end. A line of perforations is provided to allow separation of the individual sheets. Each sheet has a periphery in a rectangular configuration with four edges and four corners. Each sheet is sized to confirm to any of a plurality of boxes of a variety of shapes and sizes. Each sheet also has a back surface. The back surface has no printing thereon. Each sheet also has a front surface. The front surface may be provided with decorative printing thereon. A pressure sensitive adhesive is provided. The sheet with the adhesive is removable and repositionable. The adhesive is located on the back surface along the four side edges but terminating in proximity to the four corners. In this manner an essentially rectangular adhesive frame is formed. The adhesive frame has a periphery essentially co-extensive with the periphery of the sheet. The adhesive frame also has a hollow interior and corners to facilitate handling. The adhesive frame may adhere to the front surface when wrapping a box or other item. The frame has a width that extends from the periphery toward the hollow interior. The width is approximately 0.5 inch to 1.0 inches. In this manner each sheet may be wrapped about a box or other item so that portions of the adhesive contact, engage and attach to portions of the front surface for securing the sheet wrapped about at least a portion of the box or other item.

The adhesive material forms a rectangular adhesive frame with a periphery co-extensive with the periphery of the sheet and a hollow rectangular interior and corners. The rectangular adhesive frame has a width that extends from the periphery toward the hollow rectangular. The width is approximately 0.5 inch to 1.0 inch. The adhesive material attached thereto is wrapped about the gift box or other item. Whereby, portions of the adhesive material contact, engage and attach to portions of the wrapping material for generally securing of the sheet of detachable material wrapped about at least a portion of the gift box or other item.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved self adhering wrapper which has all of the advantages of the prior art wrapping material and none of the disadvantages.

It is another object of the present invention to provide a new and improved self adhering wrapper which may be easily and efficiently manufactured and marketed.

It is a further object of the present invention to provide a new and improved self adhering wrapper which is of durable and reliable constructions.

An even further object of the present invention is to provide a new and improved self adhering wrapper which is susceptible of a low cost of manufacture with regard to both materials and labor, and which accordingly is then susceptible of low prices of sale to the consuming public, thereby making such self adhering wrapper economically available to the buying public.

Still yet another object of the present invention is to provide a new and improved self adhering wrapper which provides in the apparatuses and methods of the prior art some of the advantages thereof, while simultaneously overcoming some of the disadvantages normally associated therewith.

Even still another object of the present invention is to provide a self adhering wrapper for allowing an item to be placed therein and concealed when the self adhering wrapper is placed in an operable configuration and further allowing reuse of the self adhering wrapper.

Lastly, it is an object of the present invention to provide a new and improved sheet of flexible material. The sheet has a periphery in a rectangular configuration with four edges and four corners sized to conform to any of a plurality of boxes and other items having a variety of shapes and sizes. Each sheet also has a back surface without any printing thereon and a front surface which may have decorative printing thereon. A pressure sensitive adhesive which is repositionable is located on the back surface along the four side edges but terminates in proximity to the four corners. The adhesive forms an essentially rectangular adhesive frame having a periphery essentially co-extensive with the periphery of the sheet and a hollow interior and corners to facilitate handling. The adhesive may adhere to the front surface when wrapping a box or other item. The frame has a width that extends from the periphery toward the hollow interior whereby each sheet may be wrapped about a box or other item so that portions of the adhesive contact, engage and attach to portions of the front surface for securing the sheet wrapped about at least a portion of the box or other item.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a perspective view of a gift box covered by the wrapping material shown in FIG. 1, particularly indicating the user folding and attaching the wrapping material securely about the gift box.

FIG. 4 is a partial perspective view of the underside of FIG. 3 showing the adhesive portion of the wrapping material attached and secured to the front surface of the wrapping material which can be separated for reuse.

FIG. 5 is a front perspective view of the present invention showing the sheet of material the adhesive portion around the perimeter of the wrapping material.

FIG. 6 is a partial cross-sectional side view taken along line 6—6 showing the layer of adhesive covered by the backing strip, the wrapping material, and the polymer strip.

FIG. 9 is a perspective illustration of a box being wrapped with the sheet material of the prior figures.

FIG. 10 is a perspective illustration of yet another alternate embodiment of the invention with the sheet materials being stacked, one upon the other.

DESCRIPTION OF THE PREFERRED EMBODIMENT

Figure 1:
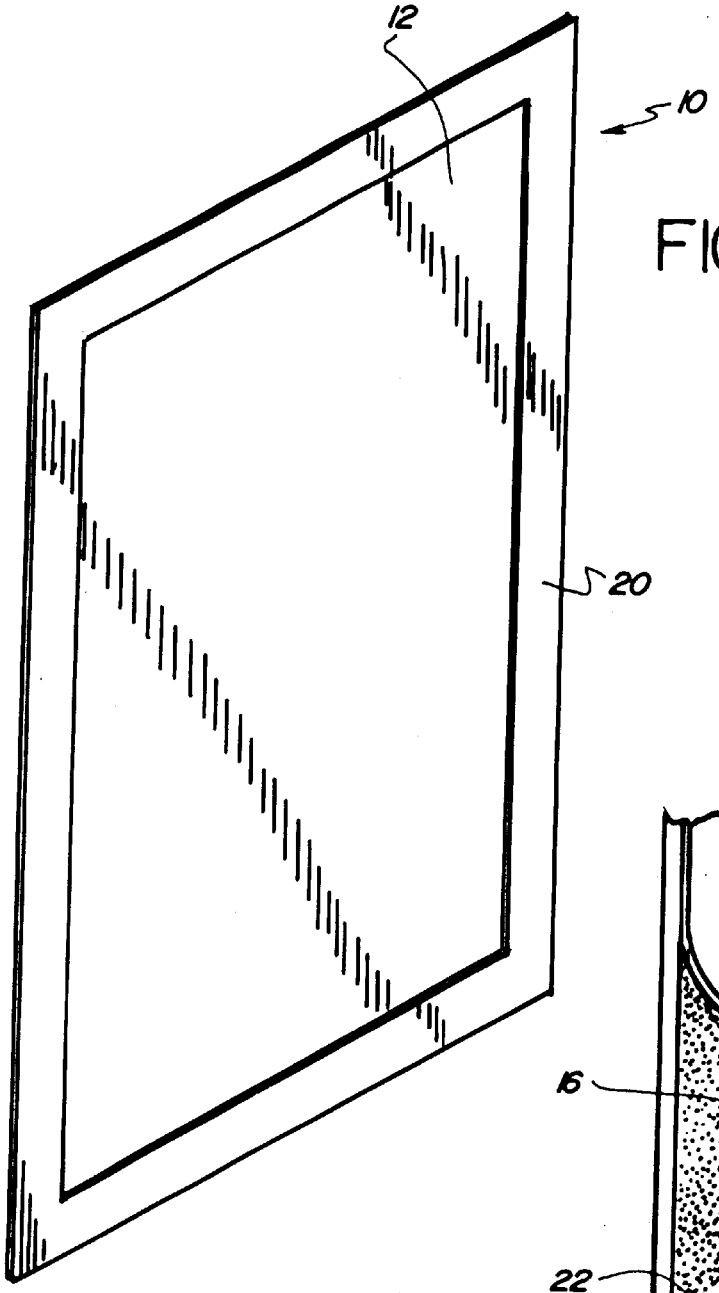
FIG. 1 is a perspective view of showing the back surface of the self adhering wrapper comprising the principles of the present invention.

With reference now to the drawings, and in particular to FIG. 1A thereof, the preferred embodiment of the new and improved self adhering wrapper embodying the principles and concepts of the present invention and generally designated by the reference numeral 10 will be described.

The present invention, the self adhering wrapper 10 is comprised of a plurality of components. Such components in their broadest context include a sheet, a roll, a stack, a ribbon (with adhesive material applied and a box. All such components are individually configured and correlated with respect to each other so as to attain the desired objective.

Specifically, the present invention includes a gift box, as shown in FIG. 3. The gift box has a rectangular horizontal bottom wall and a rectangular horizontal top wall. The top wall and bottom wall having a pair of planar vertical long walls with a pair of opposed planar vertical short walls extended there between. The gift box is for holding therein a variety of items. The gift box is not limited in shape to a square or rectangular. The structure may be in the form of a cylinder. For the purposes of this application a box structure is shown.

As best illustrated in FIG. 1, a sheet of flexible material 12 is included. The flexible material or wrapping material has a periphery in a rectangular configuration sized to conform to a variety of box-like structures. The sheet of material comprises a front surface 14 that may or may not have printing and a back surface 16 without printing. The wrapping material is comprised of a suitable material such as cloth, paper, cellophane, foil, man-made organic or polymer films, or combinations thereof. All of the listed materials may be wrapped around any item in a box or other item 11.

Figure 2:
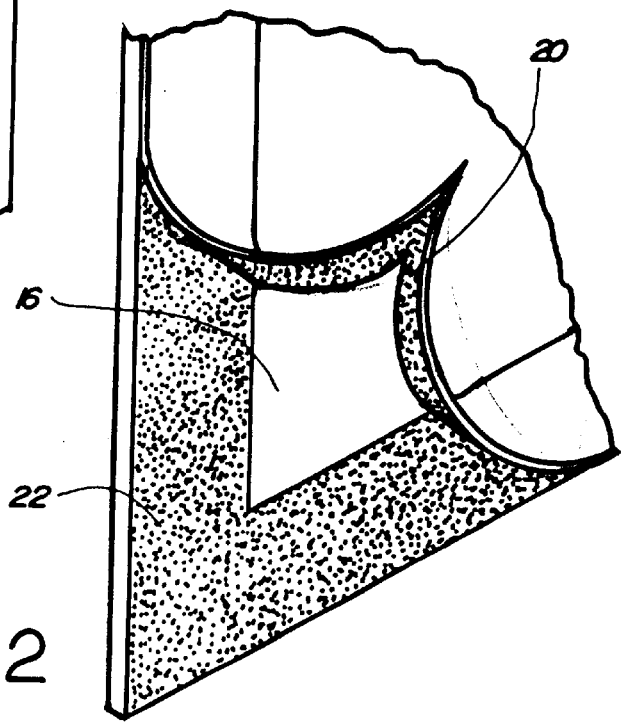
FIG. 2 is an enlarged partial perspective view of the present invention, particularly showing the backing strip being removed off the adhesive portion.
Figure 7:
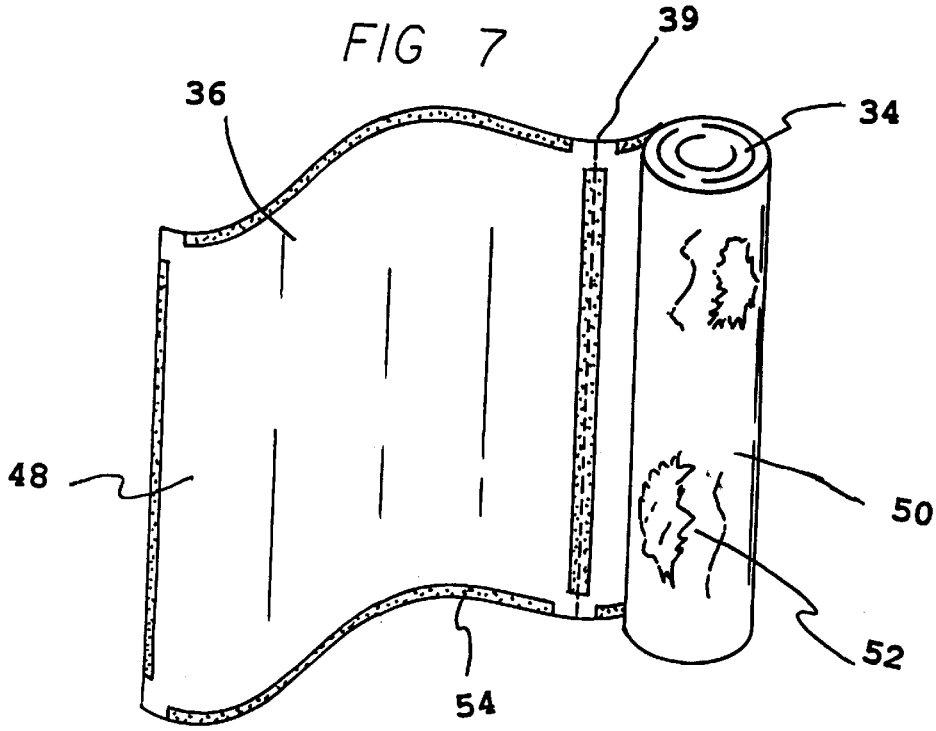
FIG. 7 is a perspective illustration of an alternate embodiment of the invention wherein the flexible sheet material is provided in roll form.
Figure 8:
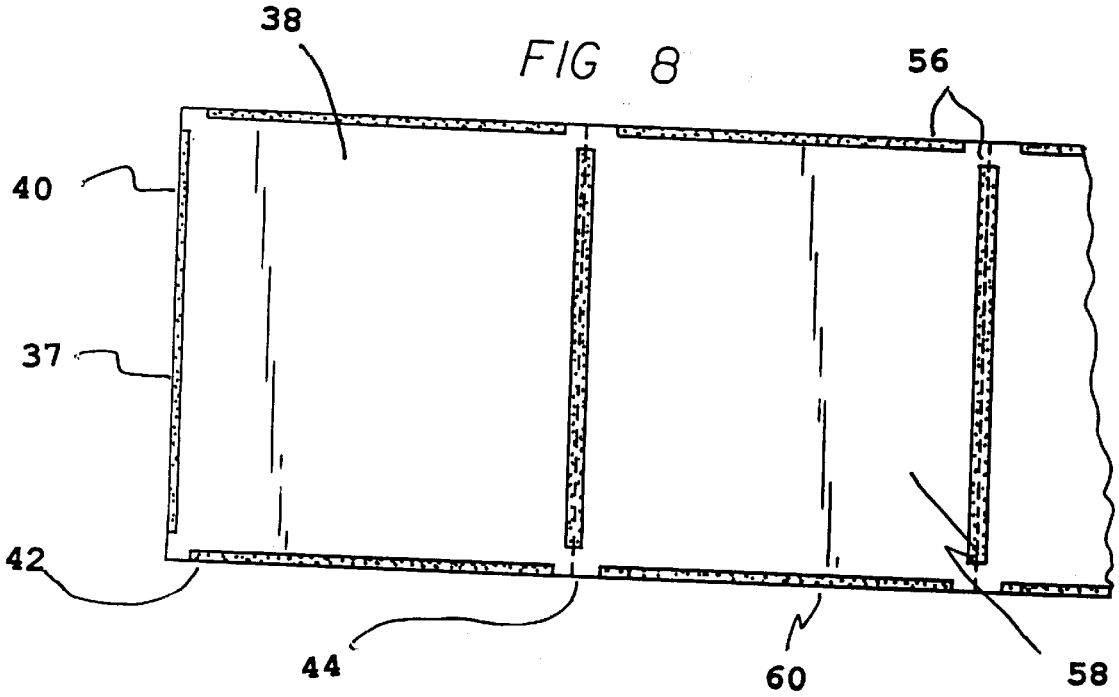
FIG. 8 is a plan view of several of the sheets of FIG. 7 rolled up for being separated, one from another, and then being used.

The wrapping material is of predetermined length, width, and thickness. Generally, the wrapping material is a relatively thin sheet of material retaining sufficient flexibility and fold ability so that the material can be easily shaped by hand about the box or other item to be covered. The sheet of material is preferably, but not limited to, a rectangular or square shape to conform to a variety of box or other item structures. Examples of popular gift box items such as the standard size boxes for blouses and shirts, smaller boxes for jewelry, and shoe boxes. A pressure sensitive adhesive material 22 is provided. The adhesive material is permanently adhered only to the periphery of the back surface of the sheet material. The adhesive material, as shown in FIG. 2, forms a rectangular adhesive frame having a periphery coextensive with the periphery of the sheet and with a hollow rectangular interior. The rectangular adhesive frame has a width that extends from the periphery toward the hollow rectangular with the width being approximately 0.5 inch to 1.0 inch. The adhesive material attached thereto is wrapped about the gift box, whereby portions of the adhesive material engage and attach to portions of the wrapping material for detachably securing the sheet of material wrapped about at least a portion of the box or other item.

The bonding occurs as the adhesive material connects to portions of the wrapping material or the box or other item that is being wrapped. The adhesive material is made of conventional type adhesives such as synthetic or natural adhesive materials. The adhesive materials, while permanently adhered to the back surfaces of the sheet material, are capable of temporarily bonding to other surfaces. The types of adhesives that may be used are easily removed after bonding to a surface without tearing that surface.

Furthermore, a detachable attached backing strip 20 is provided. The detachable attached backing strip is releasably adhered over the adhesive portion of the periphery of the wrapping material and forms a rectangular frame. The rectangular frame of the strip has a periphery coextensive with periphery of the adhesive material and the sheet and with a hollow rectangular interior. The detachable strip, as, shown in FIG. 2, is peeled off before positioning of the sheet of flexible material around the gift box. The backing strip protects the adhesive portion before use of the wrapping material and is unique to the present invention.

A protective contact portion 30 is next provided, as shown in FIG. 4. The protective contact portion is adhered only to the periphery of the front surface of the sheet material. The protective contact portion forms a rectangular protective frame that has a periphery co-extensive with the periphery of one side of the sheet. The protective contact portion is made from a polymer strip. The rectangular protective frame has a width of approximately 0.5 inch to 1.0 inch. Whereby, when the adhesive material is wrapped about the box-like structure portions of the adhesive material engages and connects to the protective contact portion to be detachably secured thereabout.

In an alternate embodiment of the invention, a roll 34 of flexible material 36 is provided. The roll is formed of a plurality of individual sheets 38 coupled end 37 to end 37. A line 39 of perforations is provided to allow separation of the individual sheets. Each sheet has a periphery 40 in a rectangular configuration with four edges 37, 42 and four corners 44. Each sheet is sized to conform to any of a plurality of boxes 46 of a variety of shapes and sizes. Each sheet also has a back surface 48. The back surface has no printing thereon. Each sheet also has a front surface 50. The front surface may be provided with decorative printing 52 thereon. A pressure sensitive adhesive 54 is provided. The sheet with the adhesive is removable and repositionable. The adhesive is located on the back surface along the four side edges but terminating in proximity to the four corners 44. In this manner an essentially rectangular adhesive frame 56 is formed. The adhesive frame has a periphery essentially co-extensive with the periphery of the sheet. The adhesive frame also has a hollow interior 58 and corners 44 to facilitate handling. The adhesive frame may adhere to the front surface when wrapping a box or other item. The frame has a width 60 that extends from the periphery toward the hollow interior 58. The width is approximately 0.5 inch to 1.0 inch. In this manner each sheet may be wrapped about a box so that portions of the adhesive contact, engage and attach to portions of the front surface for securing the sheet wrapped about at least a portion of the box or other item.

The wrapping of items within the self adhering wrapper allows for repeated use of the wrapping material. Once the adhesive material is attached on a surface during the wrapping process, it is easily unattached and allows the self adhering wrapper to be reused. Additionally, usage of the self adhering wrapper conserves paper (is recyclable), eliminates the use of tape, and thereby helps the environment.

Shown diagrammatically in FIG. 3, the flexible sheet has completely covered the box. In particular, the user is shown folding and attaching the wrapping material to securely and detachably wrap the box. The pressure sensitive adhesive material is bonded by the application of a slight pressure such as might be imposed by the hand of the user.

FIG. 5 shows the front surface of the sheet of material. An example of the adhesive area is outlined. The protective contact portion is shown along one side of the sheet. FIG. 6 is a partial cross-sectional view of FIG. 5 showing the layer of adhesive material, the sheet of wrapping material layer, and the protective contact portion.

The present invention is a self adhering wrapper that has a sheet of flexible material sized to conform to the box-like structure provided. The sheet of material has an adhesive material framed on the back surface of the sheet. A detachable attached backing strip is adhered over the adhesive material. The backing strip protects the adhesive material from dirt and dust, and ensures that it remains in a usable condition.

Figure 11:
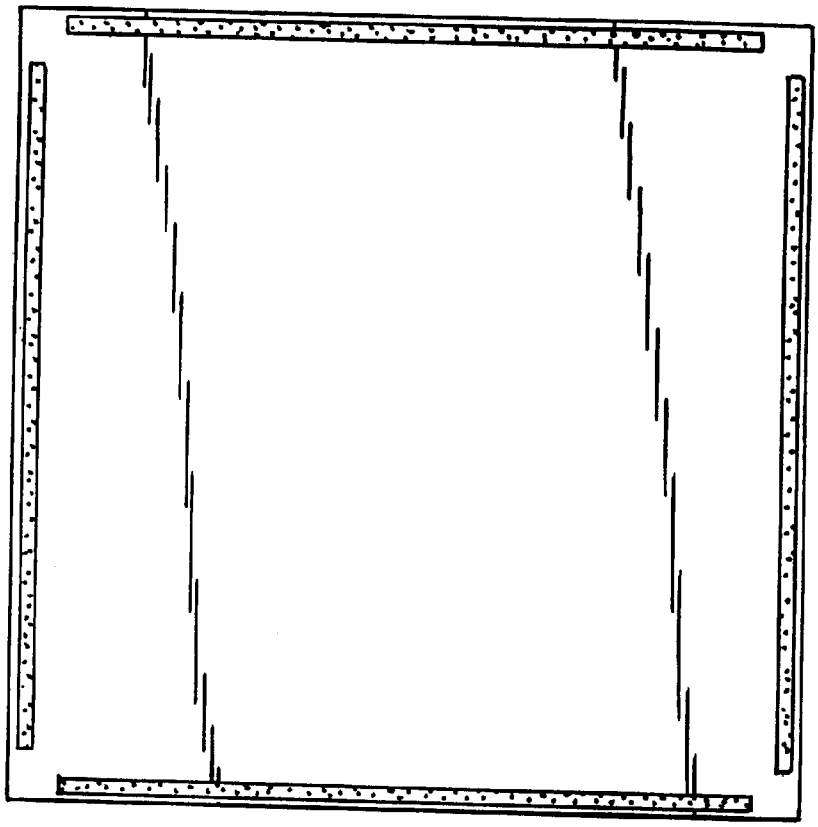
FIG. 11 is a plan view of one of the sheets shown in FIG. 10.
Figure 12:
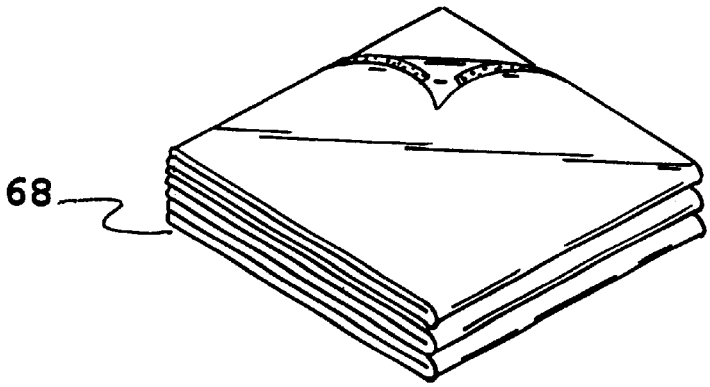
FIG. 12 is yet a further alternate embodiment of the invention with the individual sheets being folded upon themselves.
Figure 13:
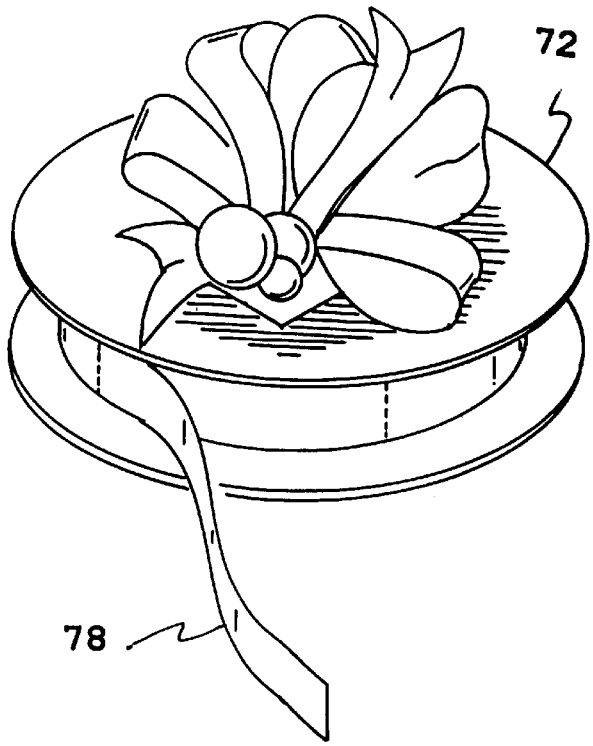
FIG. 13 is a perspective illustration of a ribbon on a roll adapted to be used in association with the sheet material of any of the embodiments of the prior Figures.
Figure 14:
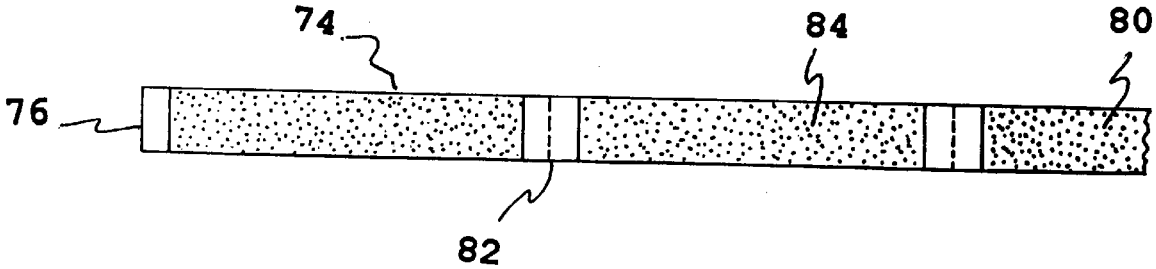
FIG. 14 is a plan view of one segment of the ribbon of FIG. 13.
Figure 15:
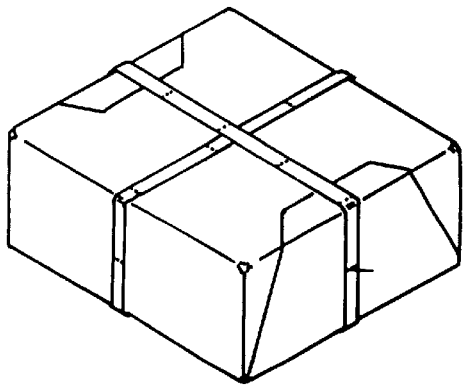
FIGS. 15 is a perspective illustration of a box of any of the prior Figures including the ribbon of FIG. 13.

An alternate embodiment of the invention is shown in FIGS. 10, 11 and 12. In such embodiment, there are provided a plurality of similar sheets 64, stacked one upon the other. In such embodiment, the back surface of each upper sheet is coupled (but removable from) to the front surface of each sheet immediately there beneath. With the corners being void of adhesive, any corner of the stack of sheet material may be utilized to be grasped and pulled from the remaining sheets in the stack for intended use. In such embodiment, it is desired that the exposed adhesive of the lowermost sheet be covered with a layer of sheet material, as for example wax paper or a sheet of the material without adhesive, to allow for the use of the last sheet at the bottom of a stack with its adhesive thereon.

The final embodiment of the invention is shown in FIG. 12. In such embodiment each flexible sheet of a plurality of similar sheets 68 is provided. Each such sheet is folded. In this manner, the adhesive of one portion of each sheet is in removable contact with the adhesive of another portion of each sheet. Each sheet is preferably folded once in a first direction and secondarily folded in a direction transverse therefrom whereby the area exposed will be one-fourth that of the entire sheet. Additional folds or other folding schemes could readily be utilized.

In addition to the sheet material described above in the various Figures, it is also possible to provide a ribbon 72. The ribbon is preferably colored or provided with other decorative indicia on one, or preferably both, of its surfaces. Such ribbon has a long length 74 and a short width 76. It is of a flexible material with a front surface 78 and a back surface 80. It is preferably provided with equally spaced perforations 82 across its width for separation purposes. In addition, a pressure sensitive adhesive 84 is provided. Each segment of ribbon is of about 6 inches in length with areas of about ¼ inch from the perforations not having adhesive as for handling purposes. The adhesive for the ribbon is similar to that used with the sheets and is located on the back surface of the ribbon providing for removal and repositioning.

The preferred material for use as the adhesive is of the type described in the aforementioned U.S. Pat. No. 5,194,299 to Fry and assigned to Minnesota Mining and Manufacturing Company. Various chemical formulations for such material are described therein. Such material is intended to be removable and repositionable and is intended to refer not only to products which can be temporarily adhered to, removed from, and repositioned on paper sheets and other similar sheets of flexible material, but also to products to which sheets can be temporarily adhered, removed and repositioned. The subject matter of such Fry patent is incorporated herein by reference. The use of this adhesive material, when compared to other adhesives such as double faces adhesives, allows a thin layer in the desired areas which will add a thickness no more than a small percentage of the thickness of the paper for convenient stacking or rolling of the sheet material.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A roll of flexible material formed of a plurality of individual sheets coupled end to end with a line of perforations providing for separation of the individual sheets, each sheet having a periphery in a rectangular configuration with four edges and four corners adapted to cover a rectilinear box with six faces, each sheet also having a back surface without any printing thereon and a front surface with decorative printing thereon, a pressure sensitive adhesive which provides for removing and repositioning of the sheet located directly on the back surface along the four side edges but terminating in proximity to the four corners to thereby form a generally rectangular adhesive frame having a periphery generally co-extensive with the periphery of the sheet and with a hollow interior and corners to facilitate handling, the sheet and adhesive adapted to adhere to at least one face of the box and to the front surface of the sheet parallel with the edges when wrapping a box, the frame having a size that extends from the periphery toward the interior with the width being approximately 0.5 inch to 1.0 inch, whereby each sheet may be wrapped about a box so that portions of the adhesive contact, engage and attach to portions of one face of the box for securing the sheet when wrapped about at least a portion of the box.

2. A sheet of flexible material having a periphery in a rectangular configuration with four edges and four corners, each sheet also having a back surface without any printing thereon and a front surface, a pressure sensitive adhesive which, provides for removal and repositioning of the sheet, located directly on the back surface along the four side edges but terminating in proximity to the four corners to thereby form generally rectangular adhesive frame having a periphery generally co-extensive with the periphery of the sheet and with a hollow interior and corners to facilitate handling with all of the corners devoid of adhesive, the adhesive and sheet adapted to adhere to the front surface when wrapping, the frame having a size that extends from the periphery toward the interior, the size of the adhesive being approximately 0.5 inches to 1.0 inches from its adjacent edge, whereby each sheet may be wrapped so that portions of the adhesive contact, engage and attach to portions of the front surface parallel with the edges.

* * * * *